United States Patent [19]

Christensen et al.

[11] 3,984,266

[45] Oct. 5, 1976

[54] PROCESS FOR BONDING A FERRO-CEMENT STRUCTURE WITH FIBERGLASS REINFORCED PLASTIC

[75] Inventors: Kenneth A. Christensen, Calistoga; Robert B. Williamson, Berkeley, both of Calif.

[73] Assignee: The United States of America as represented by the Secretary of the Navy, Washington, D.C.

[22] Filed: Apr. 22, 1974

[21] Appl. No.: 462,827

[52] U.S. Cl. ..... 156/3; 52/DIG. 7; 156/245; 156/330; 156/2; 264/257; 264/265; 428/256; 428/446; 428/450

[51] Int. Cl.[2] ..... B44C 1/22

[58] Field of Search ..... 52/DIG. 7, 515, 612; 156/3, 94, 71, 242, 2; 428/426, 446, 256, 255, 413, 415, 446, 450; 252/79.2; 264/257, 265

[56] References Cited

UNITED STATES PATENTS

| | | | |
|---|---|---|---|
| 716,371 | 12/1902 | Black et al. | 156/2 |
| 1,452,432 | 4/1923 | Miller | 52/612 X |
| 2,752,275 | 6/1956 | Raskin et al. | 428/126 |
| 2,850,890 | 9/1958 | Rubenstein | 52/612 X |
| 2,921,463 | 1/1960 | Goldfein | 52/232 X |
| 3,055,073 | 9/1962 | Gerwick, Jr. | 264/212 X |
| 3,145,502 | 8/1964 | Rubenstein | 52/515 X |
| 3,146,508 | 9/1964 | Berliner et al. | 264/228 X |
| 3,177,902 | 4/1965 | Rubenstein | 138/176 |
| 3,202,560 | 8/1965 | Michael | 156/289 X |
| 3,210,230 | 10/1965 | Tyhurst | 156/228 |
| 3,381,718 | 5/1968 | Darrow | 156/287 X |
| 3,401,069 | 9/1968 | Lorentzen | 156/94 X |
| 3,468,090 | 9/1969 | L'Hermite | 264/265 X |
| 3,591,437 | 7/1971 | Schafer | 156/245 |
| 3,811,909 | 5/1974 | Bertsch | 156/2 X |

*Primary Examiner*—George F. Lesmes
*Assistant Examiner*—Henry F. Epstein
*Attorney, Agent, or Firm*—R. S. Sciascia; Charles D. B. Curry

[57] ABSTRACT

A process for bonding a glass fiber reinforced plastic to a ferro-cement structure to improve impact strength of the ferro-cement structure comprising the steps curing the ferro-cement mortar; acid etching the mortar on the side of the ferro-cement mortar to which the glass fiber reinforced plastic is to be bonded, rinsing the mortar, drying the mortar, applying a coat of adhesive to the mortar and attaching the glass fiber reinforced plastic to the bonded mortar surface. The adhesive may be partially cured if desired.

1 Claim, 3 Drawing Figures

(SANDWICH I)

(SANDWICH II)

PROCESS FOR BONDING A FERRO-CEMENT STRUCTURE WITH FIBERGLASS REINFORCED PLASTIC

BACKGROUND OF THE INVENTION

1. Field of the Invention

The subject matter of the present invention is generally related to a process for bonding ferro-cement to an impact resistant material and more particularly a process for bonding a ferro-cement structure with a glass fiber reinforced plastic to improve the impact strength of the ferro-cement/plastic composite.

2. Description of the Prior Art

Ferro-cement has excellent tensile, compressive, and flexural strength. The main disadvantage of ferro-cement, from a strength standpoint, is its relatively low resistance to impact loading. The impact loads do not necessarily affect the structural integrity of ferro-cement; as a matter of fact, damage is localized with there being no catastrophic failure occurring in the structural strength of the shell. However, because of the brittle nature of the mortar, cracks develop in the impacted zone that penetrate through the shell, allowing, consequently, a passage of water to occur. Naturally, this is of utmost importance when ferro-cement is utilized as the hull material of a floating facility.

FRP is an extremely tough or ductile material capable of absorbing very high impact loads. Failure under impact finally occurs because of extensive deflection.

SUMMARY OF THE INVENTION

Briefly, the present invention is a process for bonding a glass fiber reinforced plastic to a ferro-cement structure to improve impact strength of the ferro-cement structure comprising the steps curing the ferro-cement mortar; acid etching the mortar on the side of the ferro-cement mortar to which the glass fiber reinforced plastic is to be bonded, rinsing the mortar, drying the mortar, applying a coat of adhesive to the mortar and attaching the glass fiber reinforced plastic to the bonded mortar surface. The adhesive may be partially cured if desired.

Bonding glass fiber reinforced plastic, hereinafter referred to as GFRP, to ferro-cement shell creates a sandwich or composite construction that has the following desirable advantages: Cracking or fracture from the impacted surface to the opposite surface of the ferro-cement shell is interrupted at the interface between the two materials by the tough, impact resisting layer of glass fiber. The very low modulus of elasticity of glass fiber, causing major flexibility problems in all fiberglass construction is completely compensated for by the ferro-cement. Natural rigidity, without hard or soft spots, prevails throughout the structure without special stiffening stringers or ribs required.

GFRP fabrication requires some type of mold. Generally, an expensive female mold is employed; otherwise a male mold or plug is utilized. Ferro-cement construction enjoys the advantage of not requiring a mold. Ferro-cement can be constructed from its "free standing" framework; i.e. the form of reinforcing bars and mesh in the ferro-cement provides its shape and support to form a rigid shell structure. Therefore, the advantage of being able to construct a free standing structure of ferro-cement without the need of expensive molds, a feature which also allows innovation and modification, is utilized, and it provides the supporting base for the application of GFRP. Hence, these two materials not only complement each other in strength and stiffness, but also in fabrication.

Finally, the ferro-cement portion of the sandwich construction provides the well-known additional advantages of having low cost, non-flammability, and low corrosion.

STATEMENT OF THE OBJECTS OF THE INVENTION

A primary object of the present invention is to provide a ferro-cement sandwich structure which has high impact strength.

Another object of the present invention is to provide a ferro-cement sandwich structure which has high body strength.

Another object of the present invention is to provide a ferro-cement sandwich structure which is low in cost, essentially non-flammable and resists corrosion by preventing the passage of water into the ferro-cement.

Other objects advantages and novel features of the present invention will become apparent from the following detailed description of the invention when considered in conjunction with the accompanying drawings wherein:

DESCRIPTION OF THE PREFERRED EMBODIMENT

In order to understand the process of bonding a ferro cement shell structure with glass fiber reinforced plastic (GFRP), a discussion of the process for making the ferro cement will be presented.

Ferro-cement is a thin shell of highly reinforced Portland cement mortar. Preferably the shells are from about ½ inch to about 1½ inches in thickness. The reinforcement is in the form of a plurality of layers of steel mesh, with or without steel reinforcing bars sandwiched midway between the layers of mesh. These bars could be orientated vertically, horizontally or diagonally or any combination thereof. The shell formed by the mesh and or steel bar is impregnated with a very rich Portland cement mortar. The above result is more than a well known reinforced concrete structure. The ferro-cement shell is characterized by a much higher degree of reinforcement and is generally considered by those skilled in the art as a separate material. Preferably a type II Portland cement is utilized because of its availability, slower setting time and excellent sulfur resistance. However, other types of Portland cement such as type V may be used if desired. A table illustrating the constituents of type II Portland cement follows in Table I.

TABLE I

| Type II Portland Cement Composition by % | |
|---|---|
| SILICA ($SiO_2$) | 22.3 |
| ALUMINA ($Al_2O_3$) | 4.7 |

TABLE I-continued

| Type II Portland Cement Composition by % | |
|---|---|
| IRON OXIDE ($Fe_2O_3$) | 4.3 |
| CALCIUM OXIDE (CaO) | 63.1 |
| MAGNESIUM OXIDE (MgO) | 2.5 |
| SULFUR TRIOXIDE ($SO_3$) | 1.7 |
| LOSS | 0.8 |
| INSOL | 0.1 |
| OTHER | 0.5 |

*Includes any FeO present calculated as $Fe_2O_3$.

The Portland cement is made in the standard manner well known in the art. A description of the making of Portland cement is described in the publication "The Chemistry of Portland Cement" by Robert Herman Bogue.

Figure 1:
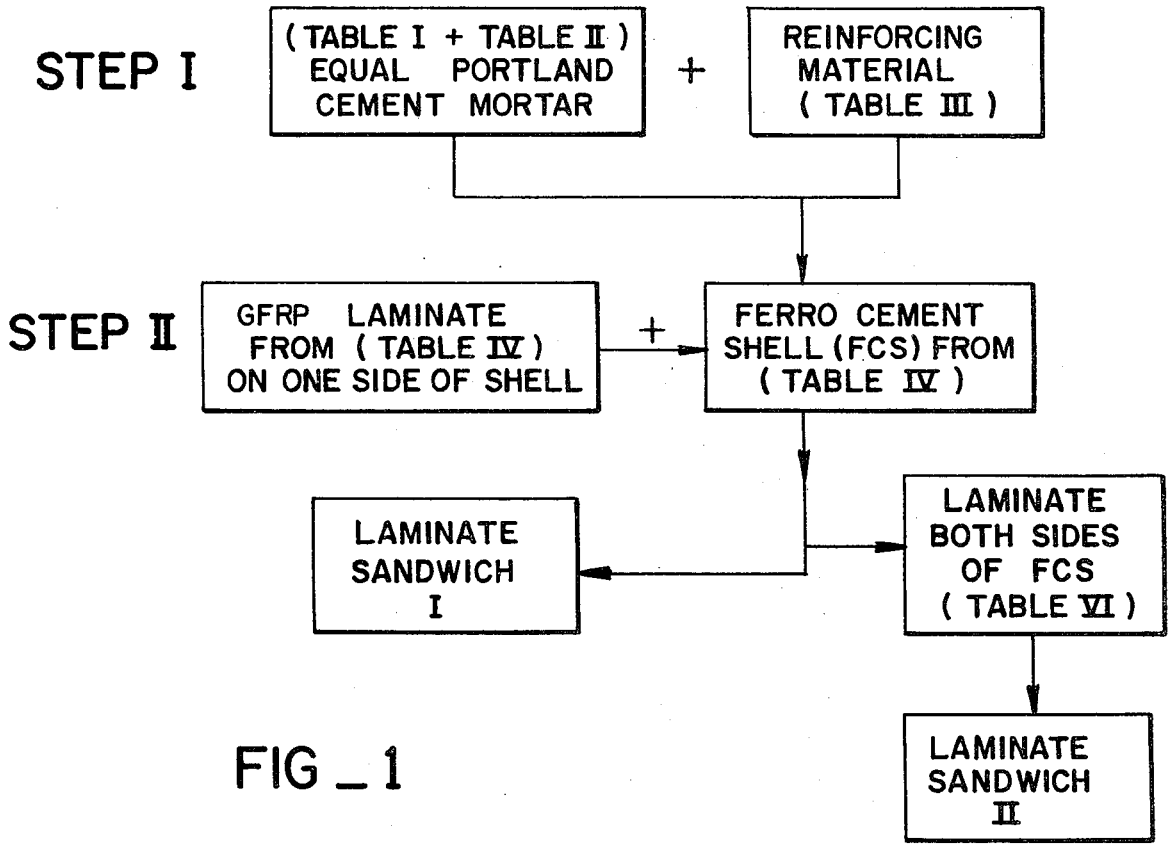
FIG. 1 is a flow diagram illustrating the process for bonding a ferro-cement shell structure with a glass fiber reinforced plastic.
Figure 2:
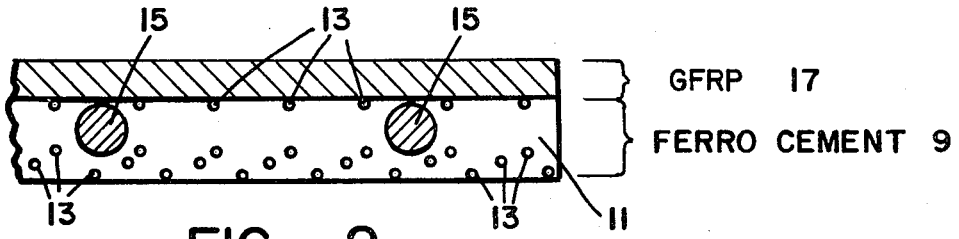
FIG. 2 is a side sectional view of one embodiment of the resultant ferro-cement sandwich structure using the process illustrated by FIG. 1.
Figure 3:
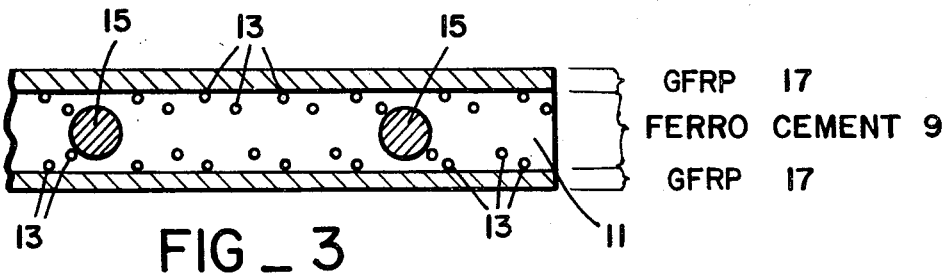
FIG. 3 is a side sectional view of another embodiment of the resultant ferro-cement sandwich structure using the process illustrated by FIG. 1.

Referring to FIGS. 1, 2 and 3 (Step I) ferro-cement 9 is comprised of the following general constituents: (1) Portland cement mortar 11 and (2) reinforcement material.

The mortar specifications are illustrated in Table II.

TABLE II

| Mortar Specifications | |
|---|---|
| Cement | Portland Type II (See Table I) |
| Sand | Olympia No. 1 or the like |
| Cement/sand ratio | 0.67 |
| Water/cement ratio | 0.40 |
| Weight of mortar | Preferably about 142 lb/ft³ |

The mortar illustrated in Table II is a rich mortar 11 of Portland cement for combining with the reinforcement material illustrate in Table III below. The reinforcement material is comprised of a hardware cloth 13 and a reinforcing bar 15 which is illustrated in Table III, see FIGS. 1 and 2.

TABLE III

| Reinforcement | |
|---|---|
| a. | Hardware cloth (steel mesh) (13) |
| | Preferably No. 2 (2 square openings/in) 19 gage |
| | Galvanized steel mesh |
| | Welded woven wire |
| | + (if desired) |
| b. | Reinforcing bar (15) |
| | No. 3 deformed Black steel (ungalvanized) |
| | High tensile strength (60,000 psi yield point) |

Preferably several thicknesses of ferro-cement should be used.

The ferro-cement shell 9 is formed by structurally combining the mortar 11 with the hardware cloth 13 and reinforcing bars 15 as described above. It should be noted that the reinforcement material shown in Table III is used for purposes of illustration only and is not intended to be a patentable limitation. Any type and/or strength of reinforcing material may be used if desired.

Referring to FIGS. 1, 2 and 3 the construction procedure for making the ferro-cement/glass fiber sandwich, hereinafter referred to as FCGF sandwich, is described below. There are two embodiments of the FCGF sandwich. FCGF sandwich I wherein the GFRP 17 is bonded to one side of the ferro-cement shell 9 and FCGF sandwich II wherein GFRP 17 is bonded to both sides of the ferro-cement shell 9.

Referring to FIGS. 1 and 2 (Step II) the construction process of making sandwich I is as follows: sandwich I consists of GFRP 17 bonded to one side of ferro-cement shell 9. The process for making ferro-cement shell 9 is described above in conjunction with Tables I – III. After the normal cure of ferro-cement shell 9, an about 15% solution of hydrochloric acid (HCL) or its equivalent is used to etch the mortar on the side of the ferro-cement shell 9 which the GFRP 17 is bonded. After etching, the mortar is water rinsed and allowed to thoroughly dry before the bonding coat of epoxy resin or the like is applied. To the prepared surface of ferro-cement shell 9 a coat of epoxy resin or the like is applied and may or may not be allowed to partially cure, after which the GFRP laminate 17 is applied to the coated surface of the ferro-cement shell 9. The constituents of FCGF sandwich I are illustrated in Table IV below.

TABLE IV

| Laminate Constituents - Sandwich I |
|---|
| Ferro cement laminate |
| Portland cement mortar |
| Reinforcing material generally consisting of: |
| steel mesh |
| reinforcing bars |
| + |
| Adhesive bonding material |
| preferably a resin |
| + |
| GFRP Laminate |
| Epoxy resin or the like |
| Glass |
| one or more layers of glass fiber material |

The numerous layers of ferro-cement 9 and GFRP 17 are to increase the impact strength of sandwich I. As an example, concentrations of the materials used in making a typical sandwich I is illustrated in Table V below.

TABLE V

| | For an area of 1 sq ft | | Percent by | | Weight per cu ft of specimen |
|---|---|---|---|---|---|
| | weight (lb) | volume (in³) | weight (%) | volume (%) | |
| Sandwich No. 1 (about ¾ in) | 10.1 | 108.0 | | | 162 |
| a) Ferro-cement (about ½ in) | | | | | |
| Preferably 4 layers No. 2 mesh | 0.98 | | | | |
| 6 ea. No. 3 bar (2 in centers) | 2.26 | | | | |
| Total steel | 3.14 | 11.4 | 32 | 11 | |
| Mortar | 4.96 | 60.6 | 49 | 56 | |
| Total ferro-cement | 8.20 | 72.0 | 82 | 67 | |
| b) GFRP (about ¼ in) | | | | | |
| Glass fabric | 1.02 | | | | |
| Epoxy resin* | 0.84 | | | | |
| Total GFRP | 1.86 | 36.0 | 18 | 33 | |

*GFRP: Epoxy resin by weight approx. 55%

Referring to FIGS. 1 and 3 the process for making sandwich II is as follows: sandwich II consists of GFRP 17 bonded to both sides of ferro-cement shell 9 and additional layers of cloth may be added for strength.

The ferro-cement is the same as sandwich I except for the placement of the steel reinforcement on both sides of shell 9.

The preparation GFRP 17 is the same as sandwich I except that the epoxy and the GFRP 17 laminate is applied to both sides of the ferro-cement 9. The constituents of sandwich II is illustrated in Table VI below.

TABLE VI

| Laminate Constituents - Sandwich II |
|---|
| Ferro cement laminate |
| Portland cement mortar |
| Reinforcing material generally consisting of: |
| steel mesh |
| reinforcing bars |
| + |
| Adhesive bonding material |
| preferably a resin |
| + |
| GFRP Laminate, top and bottom |
| Epoxy resin or the like |
| Glass |
| one or more layers of glass fiber material |

The concentrations of the materials employed in making a typical sandwich II is illustrated in Table VII.

TABLE VII

| | For an area of 1 sq ft | | Percent by | | Weight per cu ft of specimen |
|---|---|---|---|---|---|
| | weight (lb) | volume ($in^3$) | weight (%) | volume (%) | |
| Sandwich No. 2 (about ¾ in) | 9.76 | 108.0 | | | 157 |
| a) Ferro-cement (about ½ in) | | same as sandwich No. 1 | | | |
| b) GFRP (about ⅛ in both sides) | | | | | |
| Glass fabric | 0.86 | | | | |
| Epoxy resin* | 0.70 | | | | |
| Total GFRP | 1.56 | 36.0 | 16 | 33 | |

*GFRP: Epoxy resin by weight approx. 55%

The examples illustrated in Tables V and VII are not intended to be a limiting factor in the present invention.

Referring generally to FIGS. 1 and 2, as disclosed above, the process for making the ferro cement/glass fiber sandwich is comprised of curing ferro-cement mortar 11 to form a ferro-cement mortar shell 9, acid etching the shell 9 on at least one side of the ferro-cement shell 9, applying a coat of adhesive to the at least one side, partially curing the adhesive and bonding the glass fiber reinforced plastic 17 to the at least one side of the shell 9 surface.

The resultant sandwich structure is rugged and relatively compact resistant.

What is claimed is:

1. A method for making an impact resistant structural material comprising the steps of:

a. pouring Portland cement mortar into a mold in which a plurality of layers of steel mesh are positioned with steel bars sandwiched in-between, wherein said layers of steel mesh and said sandwiched steel bars are positioned before said mortar has hardened, to form a ferro-cement structure having a thickness of from about one-half inch to about one and one-half inches and having first and second about parallel sides;

b. curing said ferro-cement structure;

c. etching said mortar on said first side with an about 15% solution of hydrochloric acid;

d. rinsing said first side with water until said hydrochloric acid solution is removed therefrom;

e. allowing said first side to thoroughly dry;

f. applying a coat of epoxy resin to said first side;

g. allowing said epoxy resin to partially cure;

h. applying a thickness of glass fiber reinforced plastic to said partially cured epoxy resin; and i. allowing said epoxy resin to completely cure.

* * * * *